US005621702A

United States Patent [19]

Lizzi

[11] Patent Number: 5,621,702

[45] Date of Patent: Apr. 15, 1997

[54] ELECTRONIC CALENDAR DISPLAY DEVICE

[75] Inventor: Ronald S. Lizzi, West Hartford, Conn.

[73] Assignee: Timex Corporation, Middlebury, Conn.

[21] Appl. No.: 349,298

[22] Filed: Dec. 5, 1994

[51] Int. Cl.[6] ..... G04B 19/24

[52] U.S. Cl. ..... 368/2.9; 40/407

[58] Field of Search ..... 360/29, 30, 28; 40/407

[56] References Cited

U.S. PATENT DOCUMENTS

| | | | |
|---|---|---|---|
| 1,921,451 | 8/1933 | Brenner | 40/109 |
| 2,499,329 | 2/1950 | Potter | 40/109 |
| 2,686,985 | 8/1954 | Shore | 40/118 |
| 3,276,198 | 10/1966 | Barbera | 58/4 |
| 3,474,558 | 10/1969 | Huber | 40/107 |
| 3,619,923 | 11/1971 | Bruner | 40/118 |
| 3,698,113 | 10/1972 | Spicer | 40/118 |
| 4,205,516 | 6/1980 | Terao | 368/29 |
| 4,251,935 | 2/1981 | Wright | 40/109 |
| 4,285,147 | 8/1981 | Kolar | 40/109 |
| 4,353,178 | 10/1982 | Maezawa | 40/107 |
| 4,540,292 | 9/1985 | Rubenstein | 368/29 |
| 4,567,680 | 2/1986 | DePaolo, Sr. | 40/109 |

FOREIGN PATENT DOCUMENTS 54-111864 1/1979 Japan .

*Primary Examiner*—Bernard Roskoski
*Attorney, Agent, or Firm*—William C. Crutcher

[57] ABSTRACT

A liquid crystal calendar display device, especially suitable for an electronic timepiece, presents a full calendar month for all possible monthly calendars. Sunday, or any other selected day of the week, appears in the leftmost displayed column, regardless of the day which is the first date in the presented month. The area occupied by the date numerals is reduced by interleaving the date numerals.

6 Claims, 14 Drawing Sheets

| | | | | | | | | | | | | |
|---|---|---|---|---|---|---|---|---|---|---|---|---|
| | | | | | | | 1 | 2 | 3 | 4 | 5 | 6 |
| 1 | 2 | 3 | 4 | 5 | 6 | 7 | 8 | 9 | 10 | 11 | 12 | 13 |
| 8 | 9 | 10 | 11 | 12 | 13 | 14 | 15 | 16 | 17 | 18 | 19 | 20 |
| 15 | 16 | 17 | 18 | 19 | 20 | 21 | 22 | 23 | 24 | 25 | 26 | 27 |
| 22 | 23 | 24 | 25 | 26 | 27 | 28 | 29 | 30 | 31 | | | |
| 29 | 30 | 31 | | | | | | | | | | |

*Fig. 2 (Prior Art)*

| | | | | | | |
|---|---|---|---|---|---|---|
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

*Fig. 2a (Prior Art)*

| | | | | | | |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

*Fig. 2b (Prior Art)*

ELECTRONIC CALENDAR DISPLAY DEVICE

This invention relates generally to an electronic calendar display device of the liquid crystal type. More specifically, this invention relates to an electronic calendar display device of the liquid crystal type which can produce displays of all possible monthly calendars, where Sunday is presented in the leftmost displayed column regardless of the calendar month.

BACKGROUND OF THE INVENTION

Electronic calendar display devices suitable for timepieces and capable of displaying a full calendar month, where Sunday always appears in the leftmost displayed column, are known. An example of such a device is U.S. Pat. No. 4,353,178, issued on Oct. 12, 1982 and assigned to Kabushiki Kaisha Suwa Seikosha. The '178 patent discloses a liquid crystal display device which has two transparent baseplates stacked in alignment, with a liquid crystal material sandwiched in between. Six rows, 1–6, and ten columns, a–j, of electrodes are formed on each baseplate, as shown in FIGS. 1*a* and 1*b*. The overlapped electrode groups for display of dates are organized so that each row indicates a week. The first overlapped electrode row 1 has seven consecutive numerals, 1 to 7, starting at the fourth column d. The second overlapped electrode row 2 includes ten consecutive numerals, 5 to 14. The sixth row 6 includes nine consecutive numerals, 23 to 31. The third 3, fourth 4 and fifth 5 rows each include ten numerals; however, the electrode patterns at some positions are divided into small electrode segments such that more than one electrode segment is required to form a digit and more than one numeral can be formed at a given position on the display panel by selective driving of electrode segments. More particularly, in row 3, in the tens digit, the numeral 2 can be changed to the numeral 1 and vice versa. This construction applies in columns i and j. In row 4, there can be an interchange in displaying 2 or 1 for the tens portion of the date numeral, depending upon the electrodes which are driven, and this construction is applied in every column except column a. In the fifth row 5, certain tens digits can be either 3 or 2, and certain tens digits can be 2 or 1. This construction applies to rows a through i. The electrodes are driven by a V-2 V AC amplitude selective multiplexed system.

Depending upon the month which is to be displayed, either rows 1 through 5 are used or rows 2 through 6 are used. Then, generally seven columns are selected from the ten available columns a–j to be driven to display a month. The columns are selected in correspondence with the first day of the month.

The primary drawback of the '178 patent is its employment of electrode segments for certain tens digits. Although electrode segments do not pose problems for large numbers, segmenting small numbers, such as would be used for a calendar display in a watch, presents two difficulties. First, segmenting small numbers makes them difficult to read. Second, and perhaps of greater significance, is the technical feasibility problem posed by the more complex multiplexing scheme required for the segmented tens digits of small numbers.

Another approach in the construction of a full calendar month display for a timepiece is shown in FIG. 2. The display panel has thirteen columns of date numerals; however, on any given month, the date numerals are visibly displayed in only seven consecutive columns. Thus, there is a surplus of six columns which are not visibly displayed. This leads to an unbalanced display configuration for some calendar months as illustrated in FIGS. 2*a* and 2*b*, and the portion of the display panel driven for display is small and difficult to see and read, since thirteen full-width columns are required to display all of the months.

Accordingly, it is one object of the present invention to provide an improved liquid crystal calendar device, especially suitable for an electronic timepiece, capable of displaying a full calendar month with Sunday being in the leftmost displayed column.

Another object of this invention is to provide an improved liquid crystal calendar device where the date numerals are legible even when occupying a small area.

A further object of this invention is to provide an improved liquid crystal calendar device having a balanced display configuration with a simple multiplexing scheme.

Still another object of this invention is to provide an improved liquid crystal calendar device wherein the area occupied by the date numerals is reduced by interleaving the date numerals.

SUMMARY OF THE INVENTION

Briefly stated, the present invention concerns an improved calendar display device including first and second spaced and opposed electrode patterns having overlapped portions, and a liquid crystal material sandwiched between the electrode patterns. More specifically, the improved calendar display device comprises the overlapped portions of the opposed electrode patterns forming a plurality of rows and columns of numerals, the numerals being consecutive in alternating columns of each row such that at least three rows have two sets of consecutive numerals interleaved among the columns, and circuit means for selecting and driving the electrodes for display or non-display, the circuit means being adapted to select at least four consecutive rows, and to select alternating columns for driving to display calendar months, the leftmost column of the displayed month being the same preselected day of the week regardless of which calendar month is displayed.

BRIEF DESCRIPTION OF THE DRAWINGS

The invention, both as to organization and to method of practice, together with further objects and advantages thereof, will best be understood by reference to the following specification, taken in connection with the accompanying drawings, in which:

FIG. 2 illustrates the pattern of date numerals for another known liquid crystal calendar display;

FIGS. 2*a* and 2*b* show two calendar displays of months in accordance with the prior art of FIG. 2;

DETAILED DESCRIPTION OF THE PREFERRED EMBODIMENT

Figure 1A:
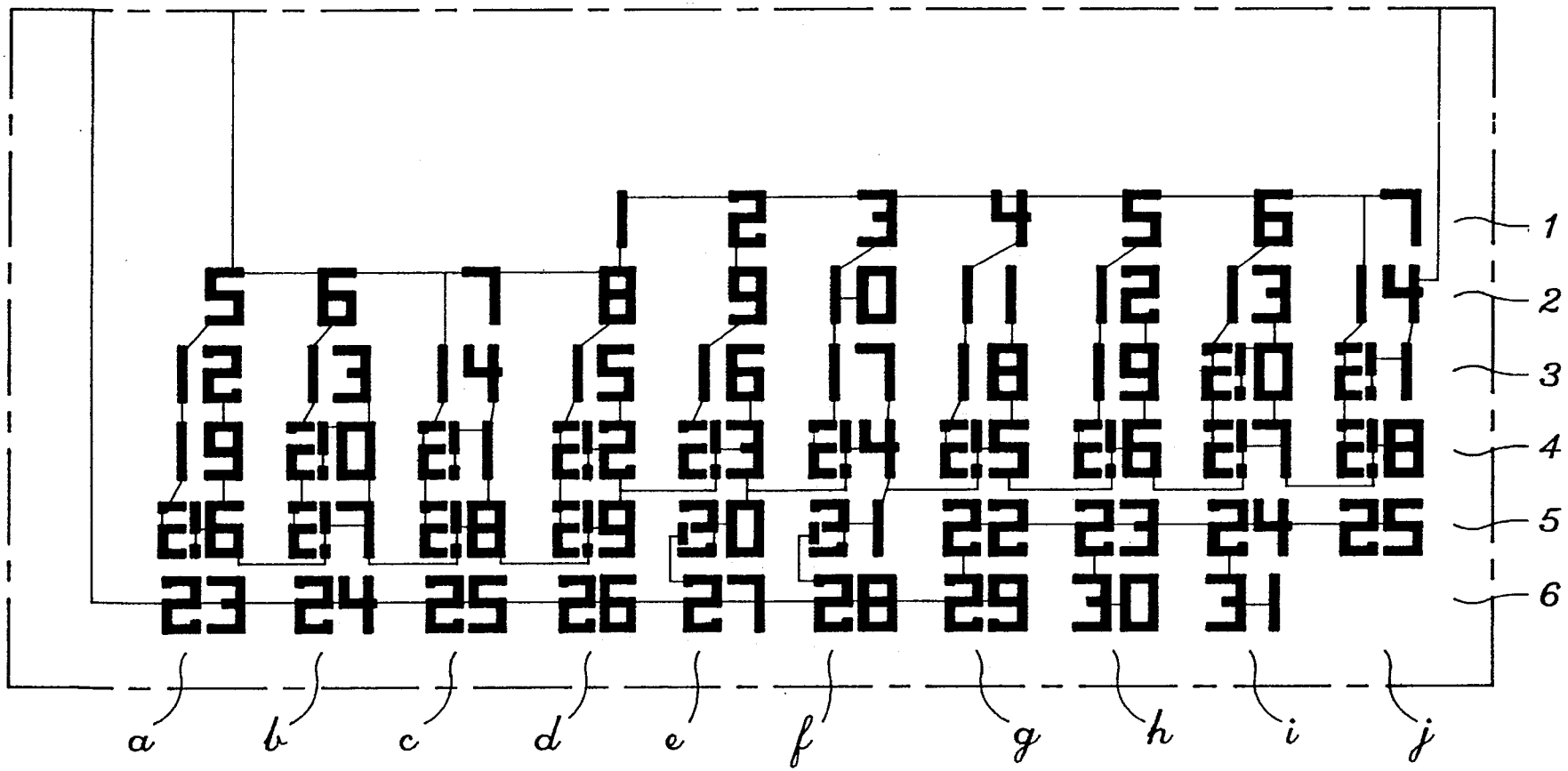
Fig. 1a (Prior Art)
FIGS. 1*a* and 1*b* illustrate the electrode patterns for a known liquid crystal calendar display.
Figure 1B:
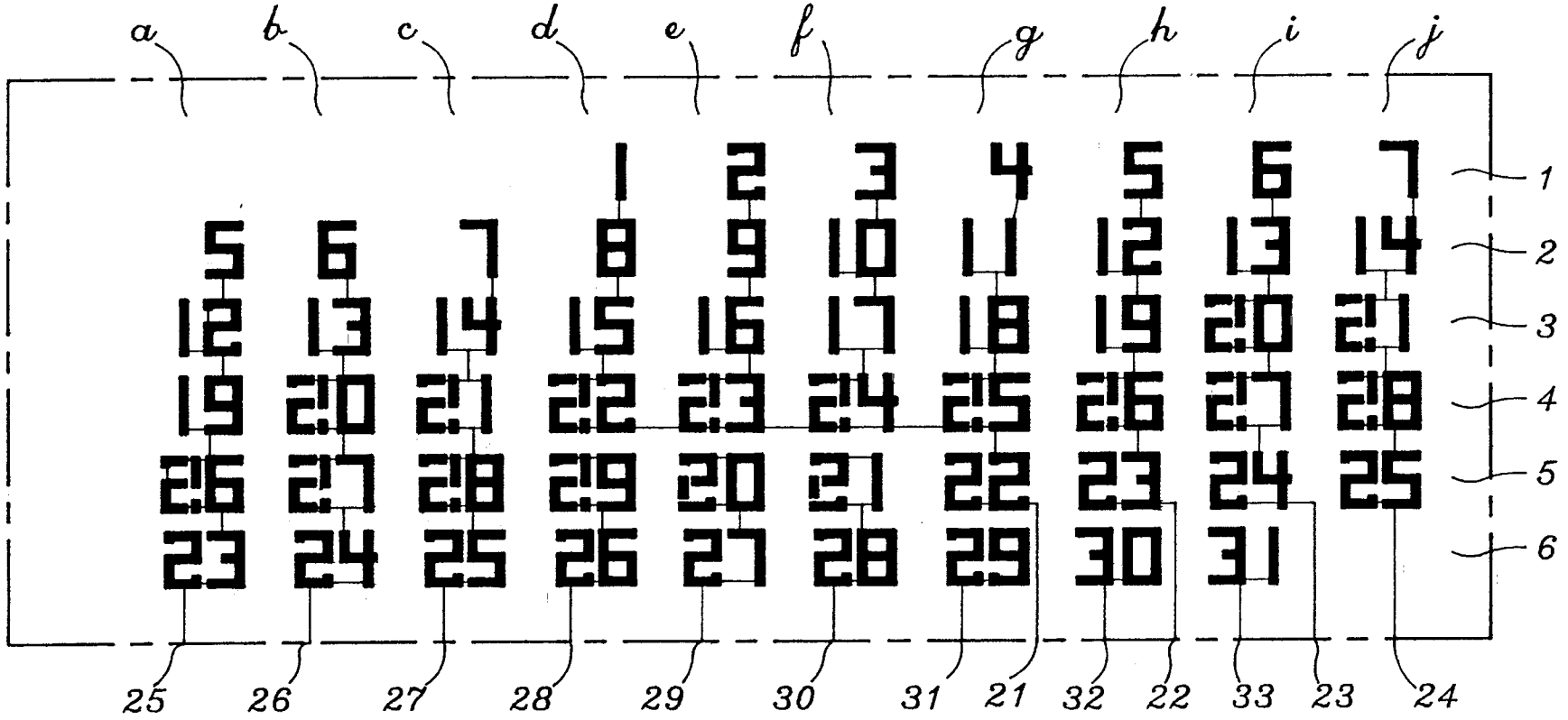
Fig. 1b (Prior Art)
Figure 3:
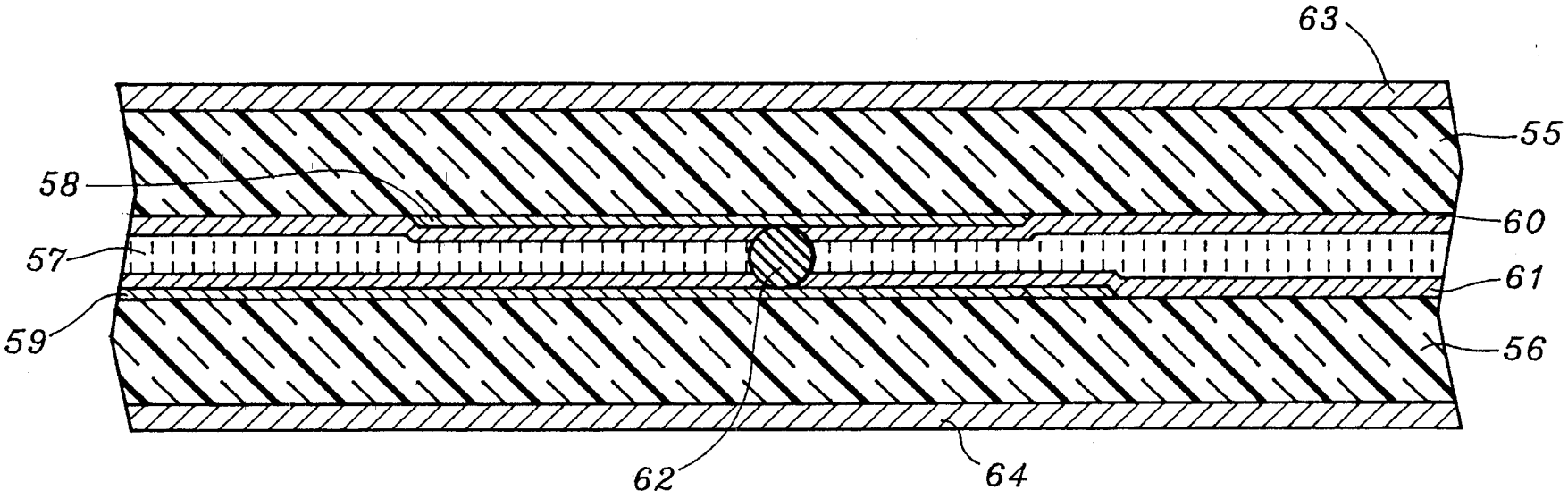
FIG. 3 is a fragmentary view in cross section of a liquid crystal display element.

FIG. 3 shows the structure of a typical liquid crystal display (LCD) consisting of two transparent baseplates 55, 56 sandwiching a liquid crystal material 57. The inner surfaces of the baseplates 55, 56 are coated with transparent electrodes 58, 59, usually of indium-tin oxide (ITO), which define the characters, numerals or other patterns to be displayed. On top of the electrodes 58, 59, polymeric layers 60, 61 are deposited which are treated to induce adjacent molecules of the liquid crystal material 57 to maintain a defined orientation. For this reason, the polymeric layers 60, 61 are called alignment, or orientation, layers. The distance between the two baseplates 55, 56 is set within narrow limits using spacers 62 made of glass fibre or plastic. Polarizing filters 63, 64 are attached onto the outer surfaces of the baseplates 55, 56.

Figure 4A:
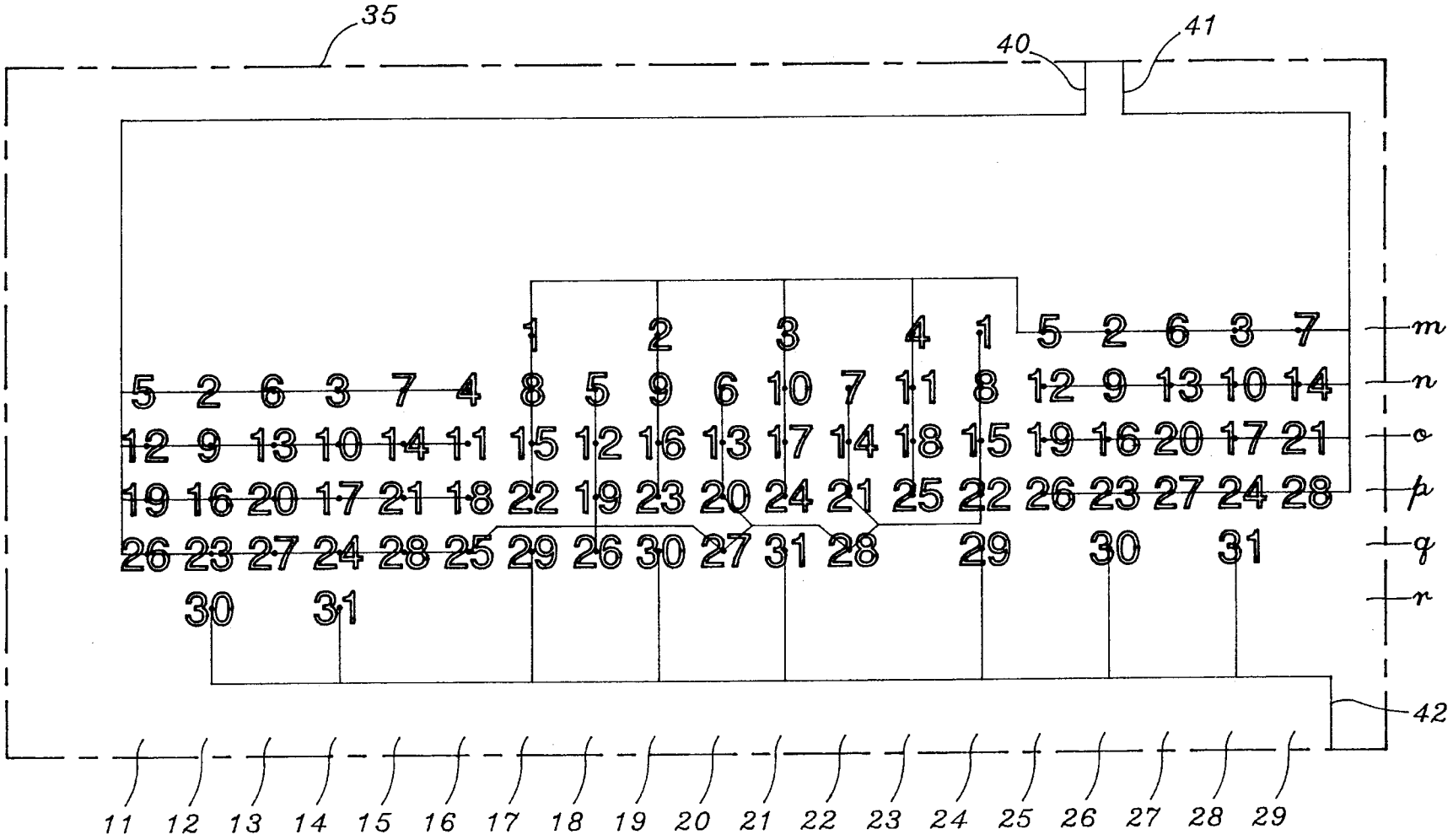
FIGS. 4*a* and 4*b* show the electrode patterns for the preferred embodiment of a liquid crystal calendar display in accordance with the present invention.
Figure 4B:
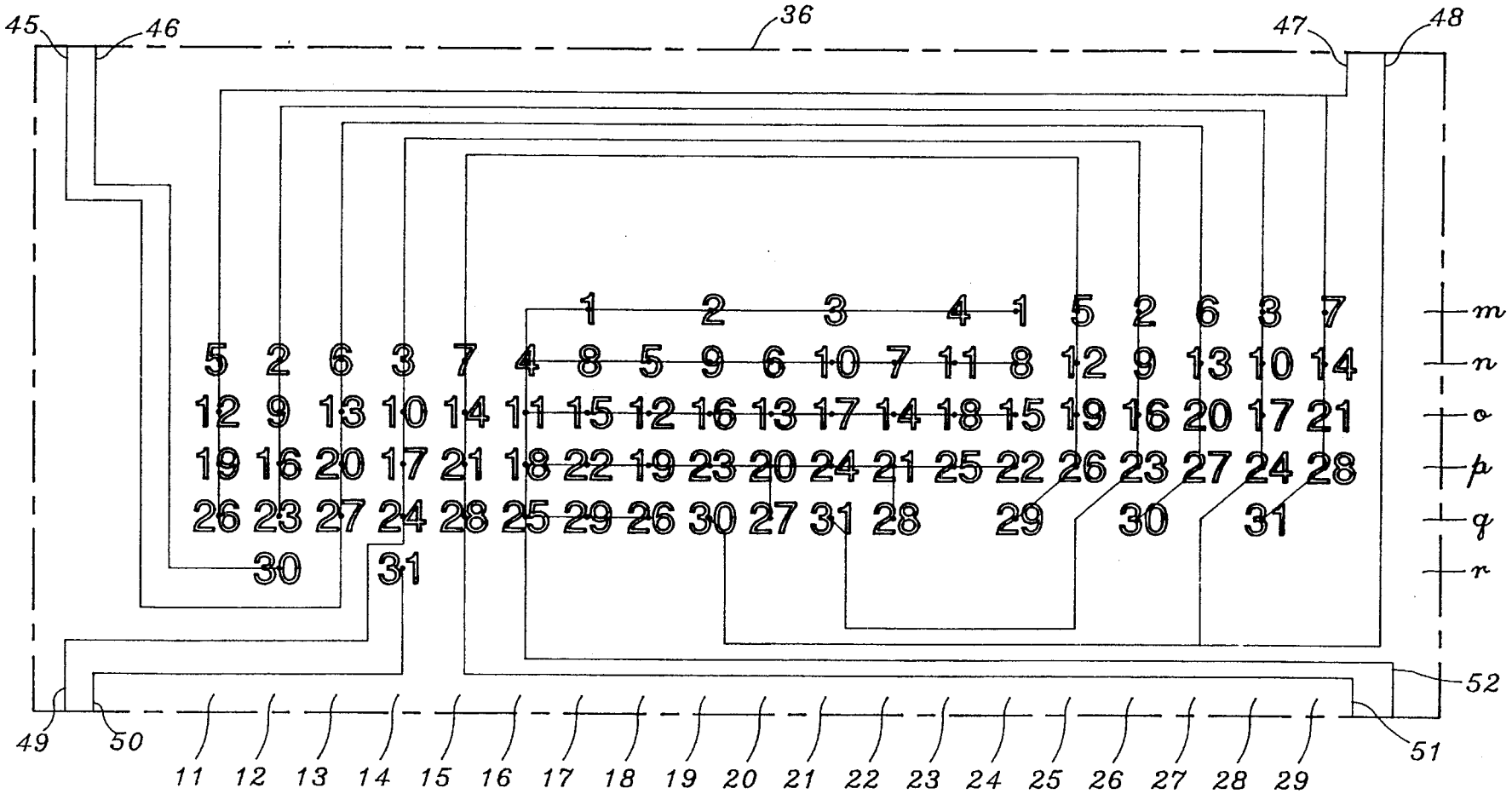

FIGS. 4*a* and 4*b* show electrode patterns for the preferred embodiment of a liquid crystal display of the present invention. In FIG. 4*a*, the electrodes are formed on a first transparent baseplate 35, and in FIG. 4*b*, the electrodes are formed on a second transparent baseplate 36. The electrode patterns consist of six horizontal rows, m–r, and nineteen vertical columns, 11–29. In contrast to prior art displays discussed hereinbefore, the vertical columns are only wide enough to accommodate the contained numerals, and do not have separating spaces between them for legibility of numerals which are adjacent to each other. This is because the present invention employs an interleaving scheme which is described hereinafter. Thus, even though the preferred embodiment of the present invention includes nineteen columns, this is comparable to ten vertical columns having separating spaces between them.

In order to display a calendar, the electrodes on the first and second baseplates 35 and 36 are stacked in alignment, with a liquid crystal material sandwiched in between as known in the art (FIG. 3). The overlapped electrode groups for display of dates are organized so that each row indicates a week.

The first overlapped electrode row m includes seven consecutive numerals, 1 to 7, positioned on every other column, starting at column 17 and ending at column 29. Furthermore, numerals 1, 2 and 3 can be found on columns 24, 26 and 28, respectively. The second overlapped electrode row n has ten consecutive numerals, 5 to 14, positioned on the odd columns, beginning at column 11. On the even columns, beginning at column 12, nine consecutive numerals, 2 through 10, can be found. The third row o includes ten consecutive numerals, 12 to 21, positioned on the odd columns, starting at column 11. And nine consecutive numerals, 9 through 17, are positioned on the even columns, starting at column 12.

In the fourth row p, there are ten consecutive numerals, 19 through 28, positioned on the odd columns, starting at column 11. On the even columns, beginning at column 12, nine consecutive numerals, 16 to 24, can be found. The fifth row q includes six consecutive numerals, 26 through 31, positioned on every other column, starting at column 11 and ending at column 21. The fifth row q also includes nine consecutive numerals, 23 to 31, on the even columns, beginning at column 12. Finally, the sixth row r has numerals 30 and 31 positioned on columns 12 and 14, respectively.

Depending upon the month to be displayed, rows m through p (case A) or m through q (case B) or m through r (case C) are used. Then, generally seven columns are selected from the nineteen available columns 11–29 to be driven to display a full calendar month. Adjacent columns of date numerals are never selected for any given month. This is because the calendar display employs an interleaving scheme, which takes advantage of the horizontal space between the date numerals by placing date numerals for different months in that space. Months which begin on a Sunday, Monday, Tuesday or Wednesday use only odd columns, while months which begin on a Thursday, Friday or Saturday use only even columns. In this manner, the total horizontal space requirement is minimized without sacrificing the legibility of the date numerals.

Figure 5A:
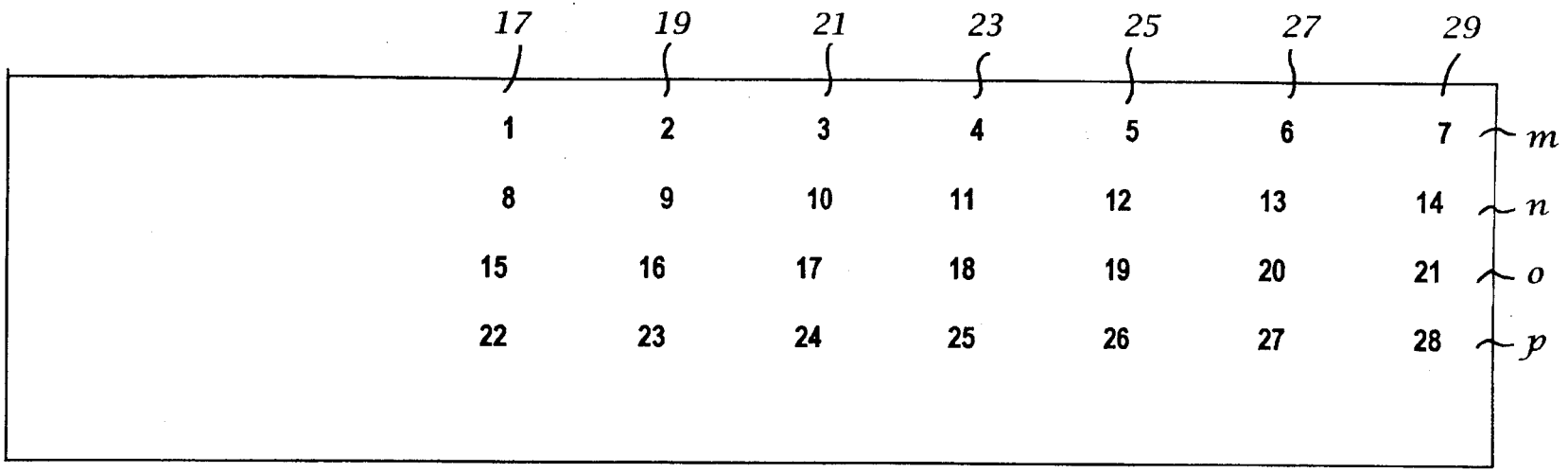
FIGS. 5*a* through 5*g* illustrate seven calendar displays of months in accordance with the preferred embodiment of the present invention.
Figure 5B:
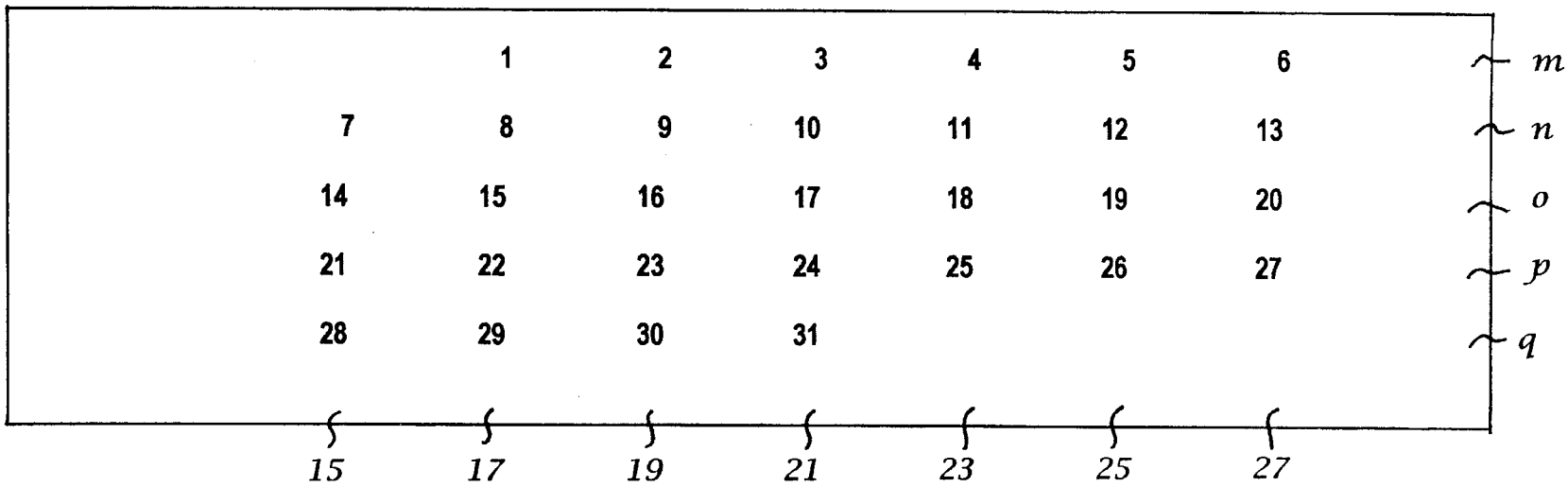
Figure 5C:
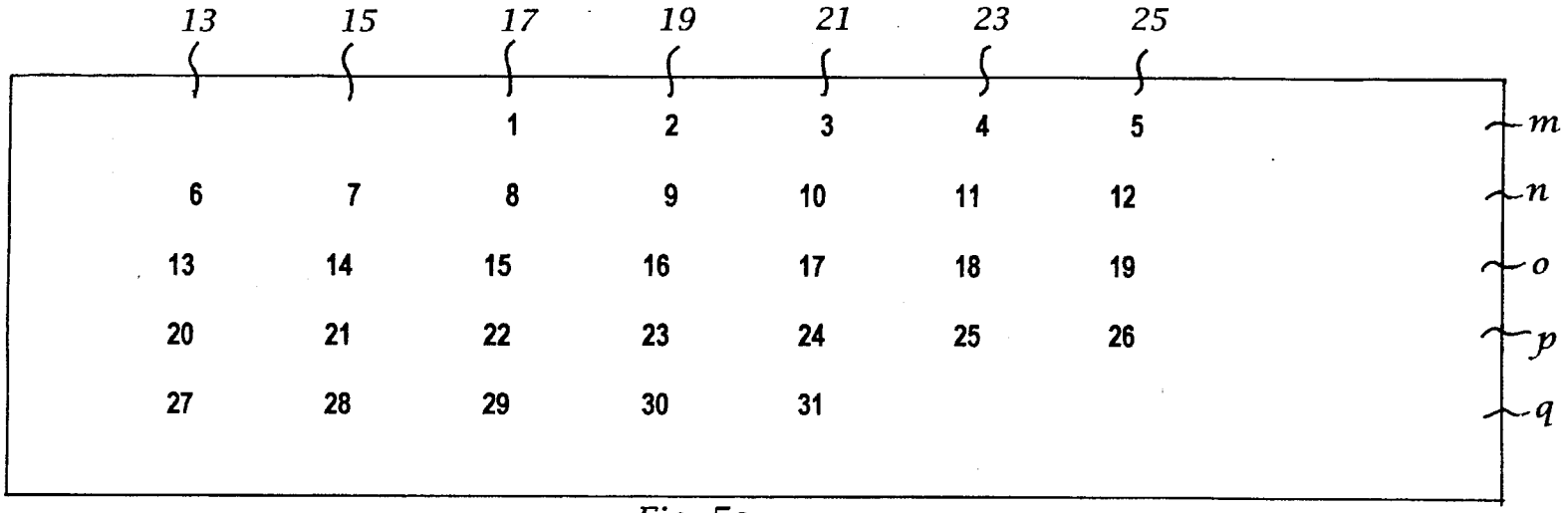
Figure 5D:
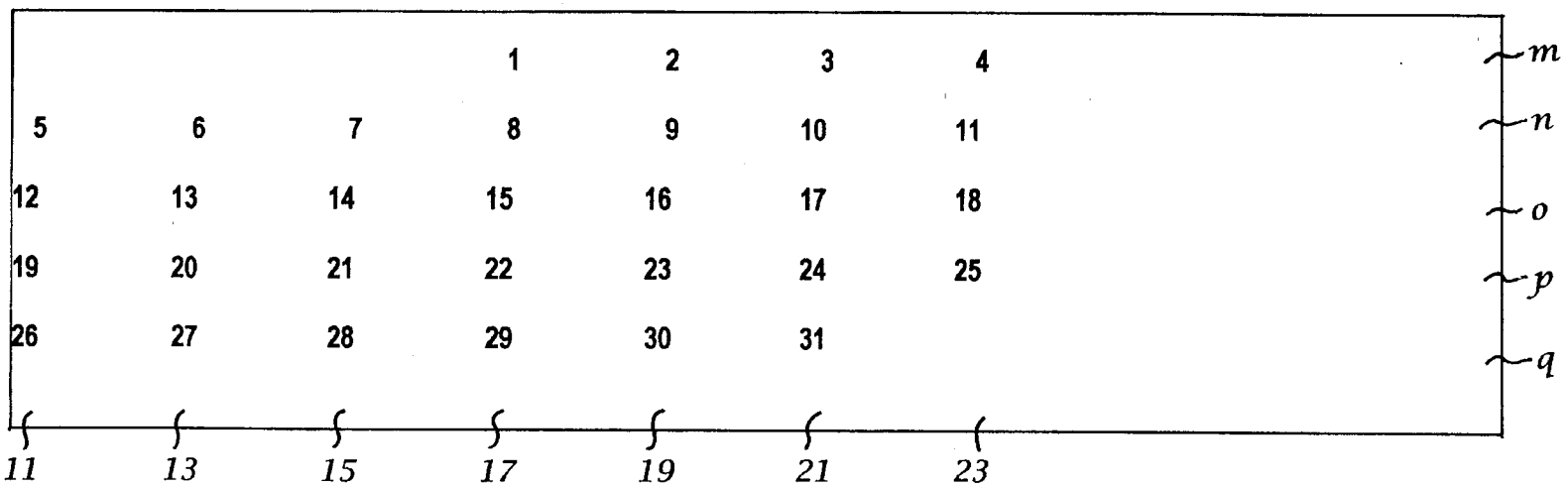
Figure 5E:
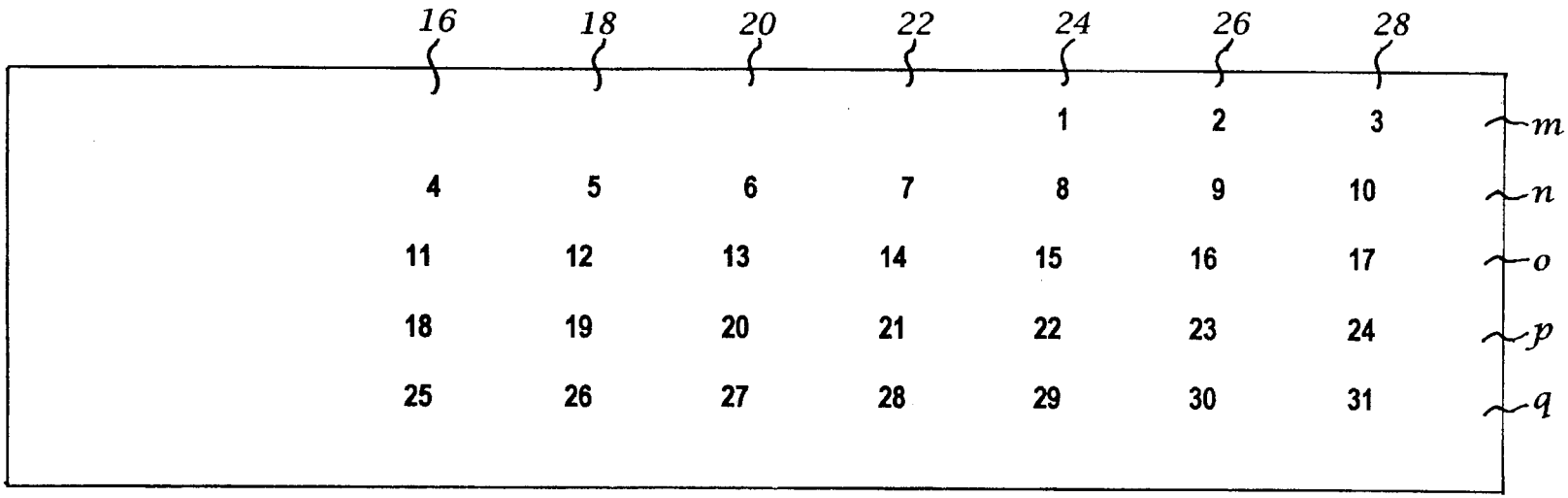
Figure 5F:
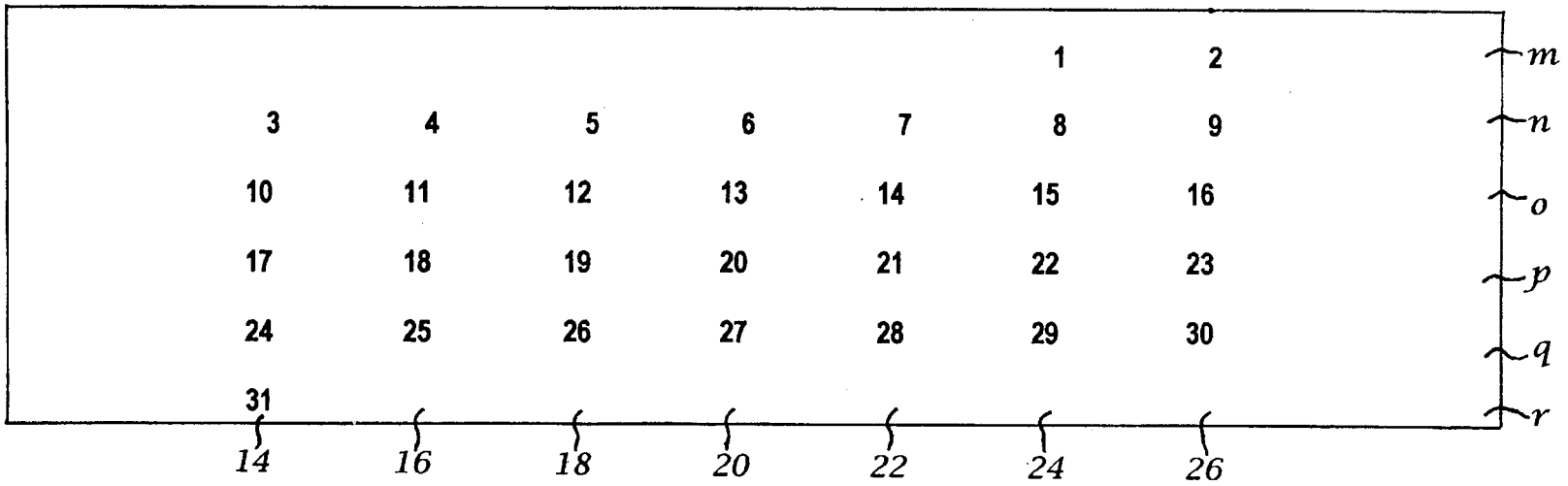
Figure 5G:
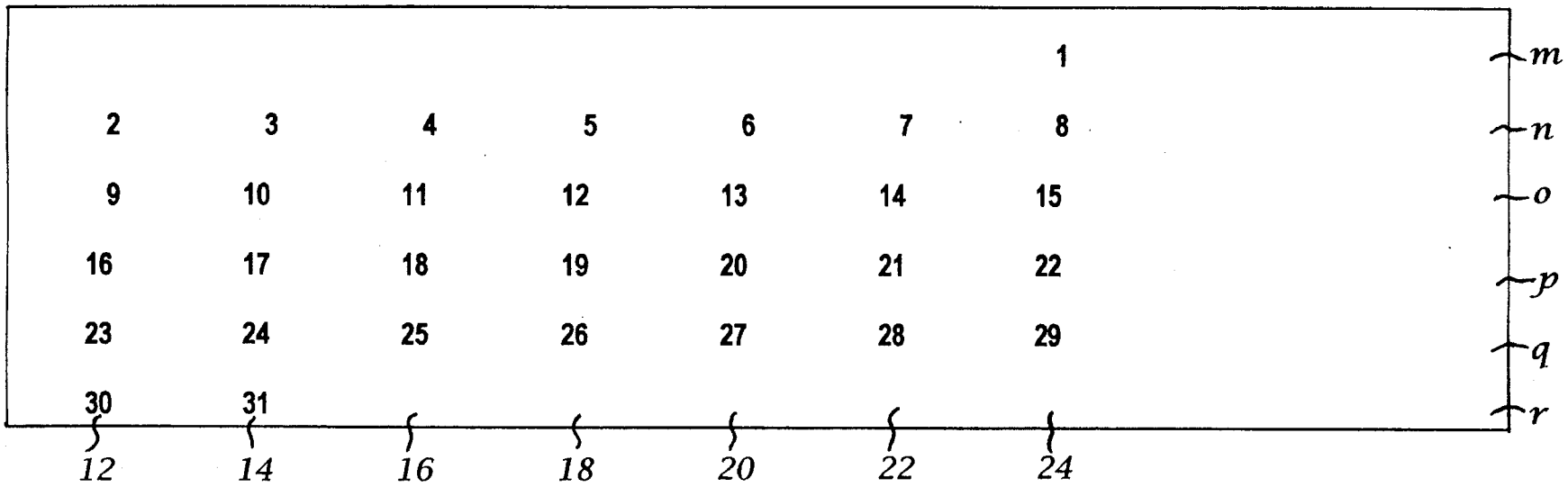

FIGS. 5*a* through 5*g* show seven calendar configurations where the first day of the month falls on a different day. Note that Sunday always appears in the leftmost displayed column. FIG. 5*a* illustrates case A, which only uses rows m through p, FIGS. 5*b* through 5*e* illustrate case B, which uses rows m through q, and FIGS. 5*f* and 5*g* illustrate case C, which uses all six rows, m through r. As can be seen from FIGS. 5*a* through 5*g*, the displayed months occupy a major portion of the display panel face area and are always substantially centered.

Applying driving signals to electrodes on both the first and second baseplates 35 and 36 so that the magnitude of the differential voltage between the opposed and overlapped electrodes determines whether the overlapped electrodes are displayed, i.e., turned on, or not displayed, i.e., turned off, is well known in the art. The present invention may utilize either multiplexed driving or direct driving. For multiplexed driving, there is a duty cycle for the displayed overlapped electrodes. Nonetheless, despite the duty cycle, the turned-on periods are of sufficient duration and repetition rate such that the display appears to the eye with constant intensity. Note that the multiplexed driving signals can be provided by conventional methods warranting no further description herein.

Figure 6:
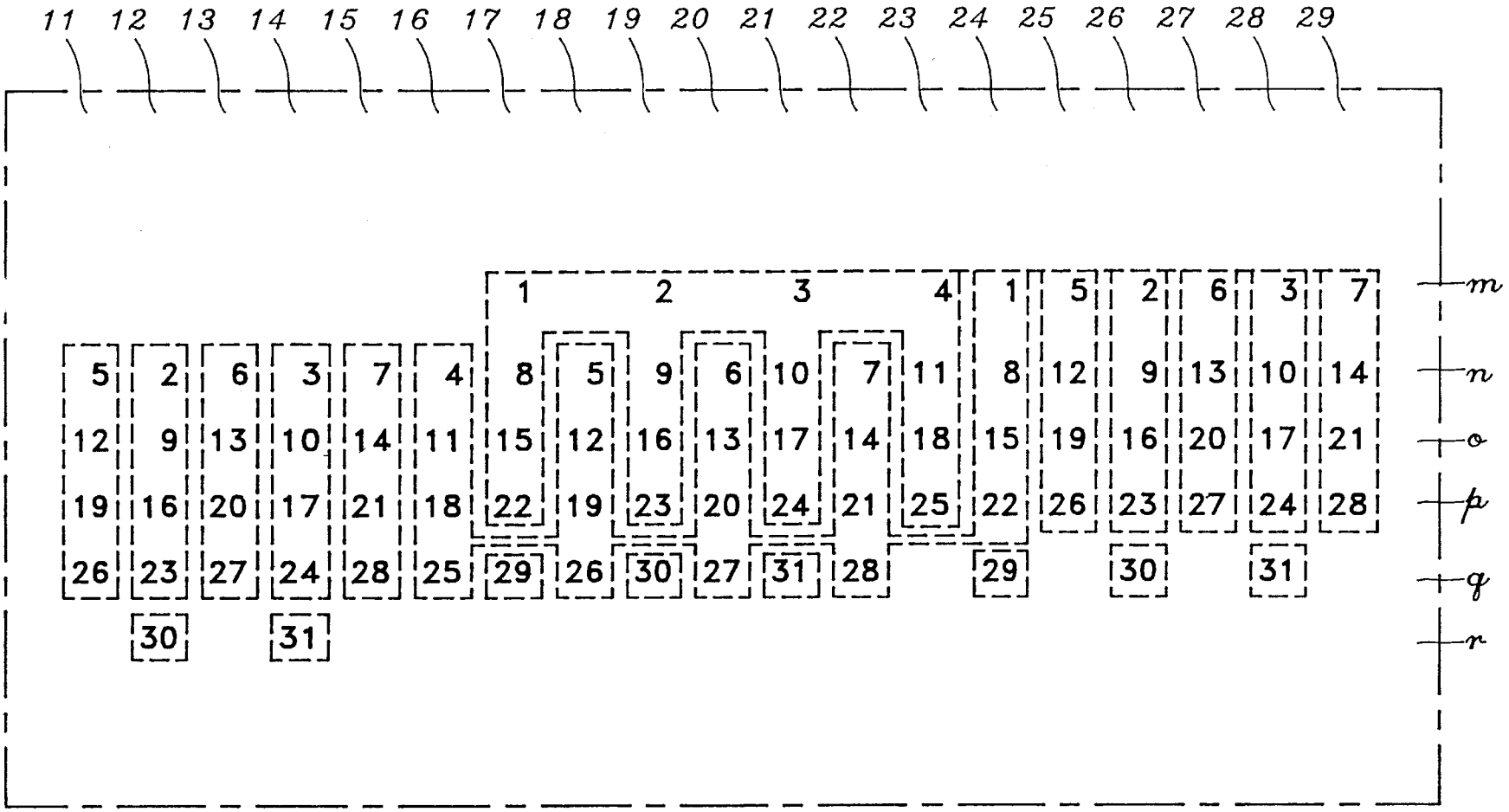
FIG. 6 shows the segments of the overlapped electrodes for the preferred embodiment of the present invention.

FIG. 4*a* shows the group connections 40, 41 and 42 for multiplexed driving of the electrodes of the first transparent baseplate 35. FIG. 4*b* shows the common electrode connections, 45, 46, 47, 48, 49, 50, 51 and 52, for multiplexed driving of the electrodes of the second transparent baseplate 36. A segment of the overlapped electrodes is identified by a specific group 40, 41 or 42 and a specific common electrode 45, 46, 47, 48, 49, 50, 51 or 52. Therefore, in the preferred embodiment of the present invention, there are twenty different segments, as illustrated in FIG. 6. These twenty segments define the minimum number of segments needed to display any month. As is understood, the group connections and the common electrode connections for multiplexed driving illustrated in FIGS. 4*a* and 4*b*, respectively, are not the only configurations available to define the twenty minimum segments. The twenty minimum segments may be defined by fewer or greater numbers of group and common electrodes.

An individual segment is selected by a combination of the group 40, 41 and 42 and common electrode 45, 46, 47, 48, 49, 50, 51 and 52 signals. Each common electrode is selected in sequence, and whether or not a segment is selected is determined by the level of the group voltage when the corresponding common electrode is addressed. To be effective, the circuits generating the driving signals for the group electrodes 40, 41 and 42 must take into account which day of the week is the first day of the month to be displayed, and whether the month has twenty-eight, twenty-nine, thirty or thirty-one days. It should be apparent to those skilled in the art that many codes can be prepared to accommodate the required conditions.

For direct driving, there would be twenty separate connections for the electrodes of the first transparent baseplate 35, each connection corresponding to an individual segment of FIG. 6. For the electrodes of the second transparent baseplate 36, there would be one common connection. The second transparent baseplate 36 of a direct-drive display is usually driven by a symmetrical square wave. To select a particular segment, this symmetrical square waveform is inversed and applied to the appropriate segment electrode of the first transparent baseplate 35. The direct driving of an LCD is well known in the art.

Figure 7:
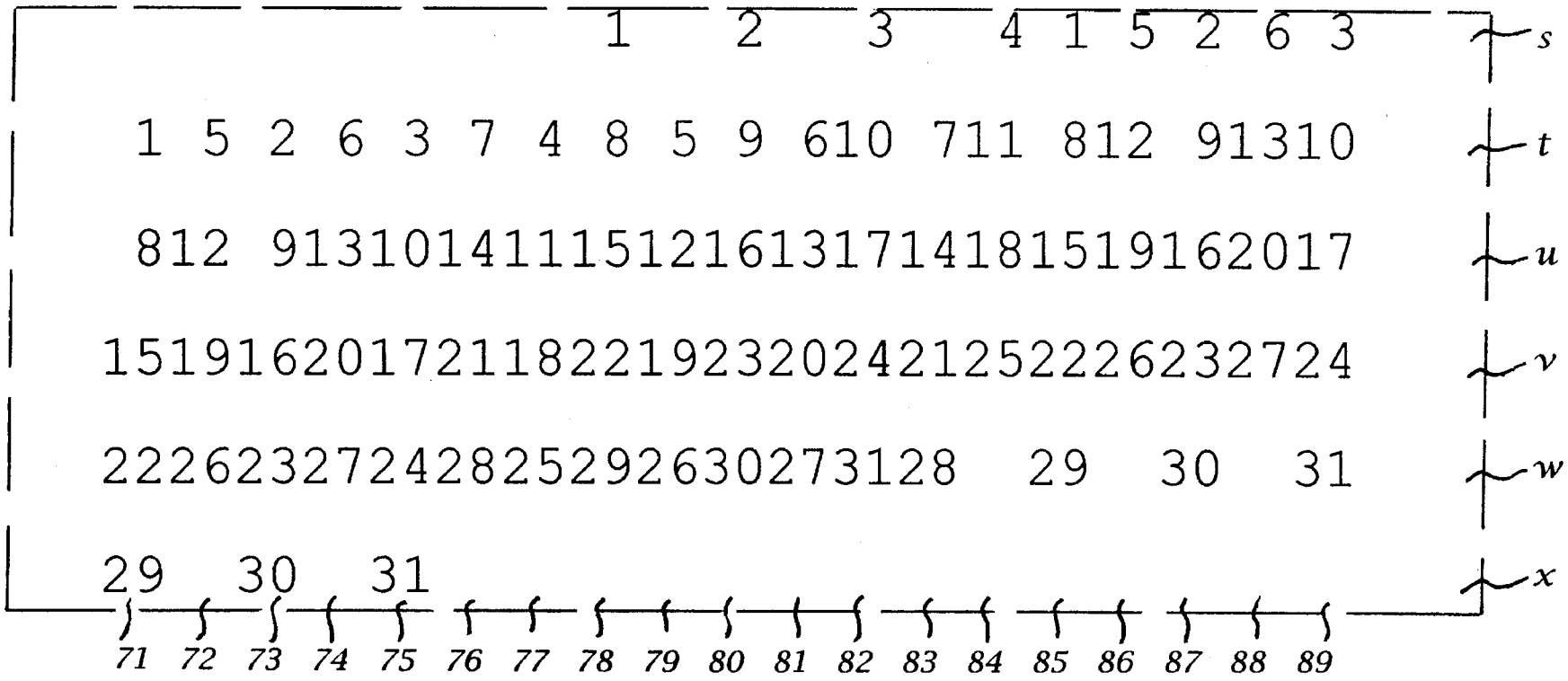
FIG. 7 illustrates a second embodiment of electrode patterns for a liquid crystal display of the present invention.

A second embodiment of electrode patterns for a liquid crystal display of the present invention is shown in FIG. 7. The electrode patterns consist of six horizontal rows, s–x, and nineteen vertical columns, 71–89. Note that columns 72–89 are identical to columns 11–28 of the preferred embodiment. The only difference between this embodiment and the preferred embodiment is the absence of column 29 and the presence of column 71 in FIG. 7.

Depending upon the month to be displayed, rows s through w (case D) or t through w (case E) or t through x (case F) or s through x (case G) are used. Then, similar to the preferred embodiment, generally seven columns are selected from the nineteen available columns 71–89 to be driven to display a full calendar month. Adjacent columns of date numerals are never selected for any given month.

Figure 8A:
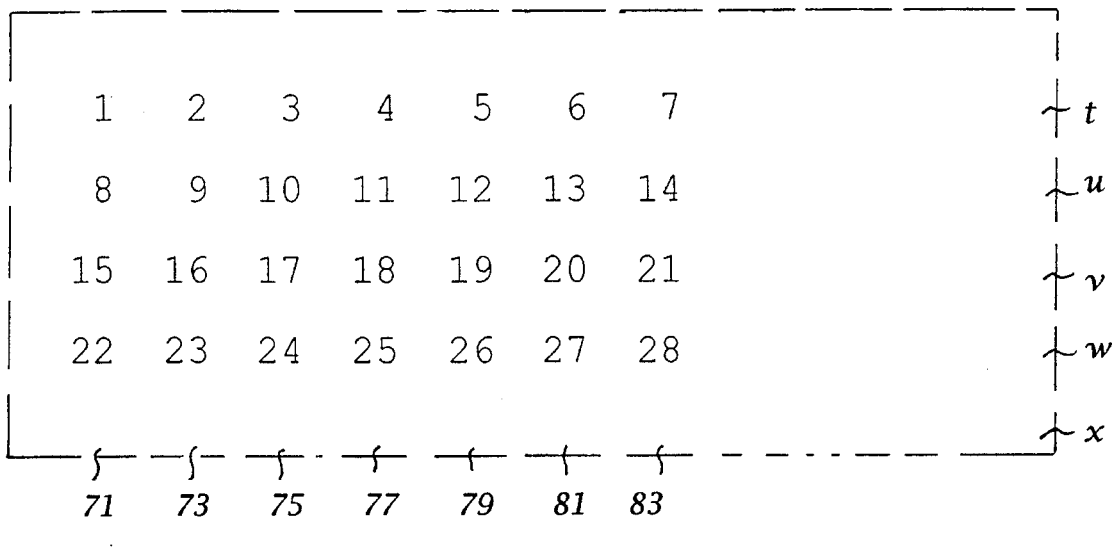
FIGS. 8*a* and 8*b* show two calendar displays of months in accordance with the second embodiment of the present invention.
Figure 8B:
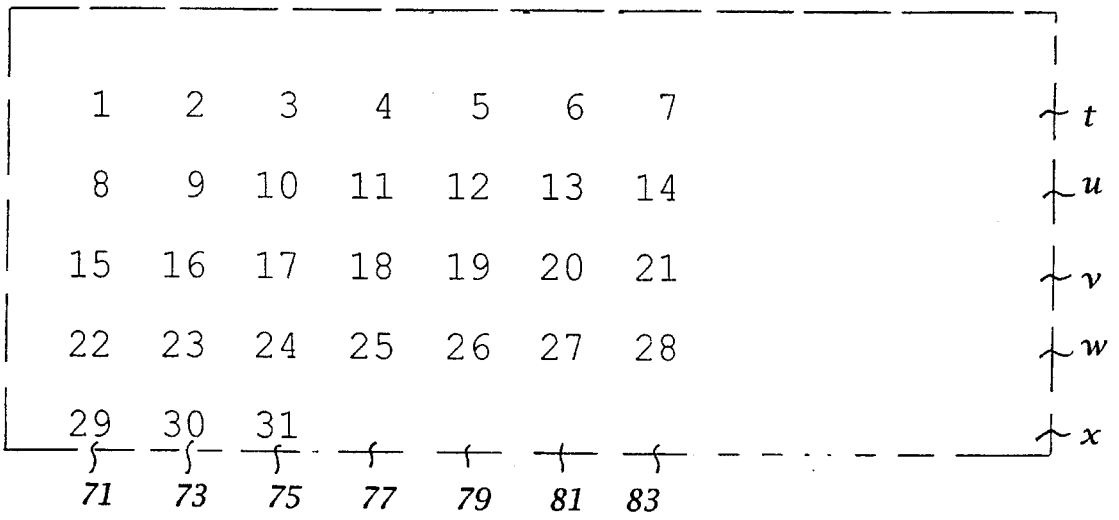

FIGS. 8*a* and 8*b* show two calendar configurations for the second embodiment of FIG. 7. FIG. 8*a* illustrates case E, which only uses rows t through w, and FIG. 8*b* illustrates case F, which uses rows t through x. As can be seen, the displayed months occupy a major portion of the display panel face area and are always substantially centered.

Figure 9:
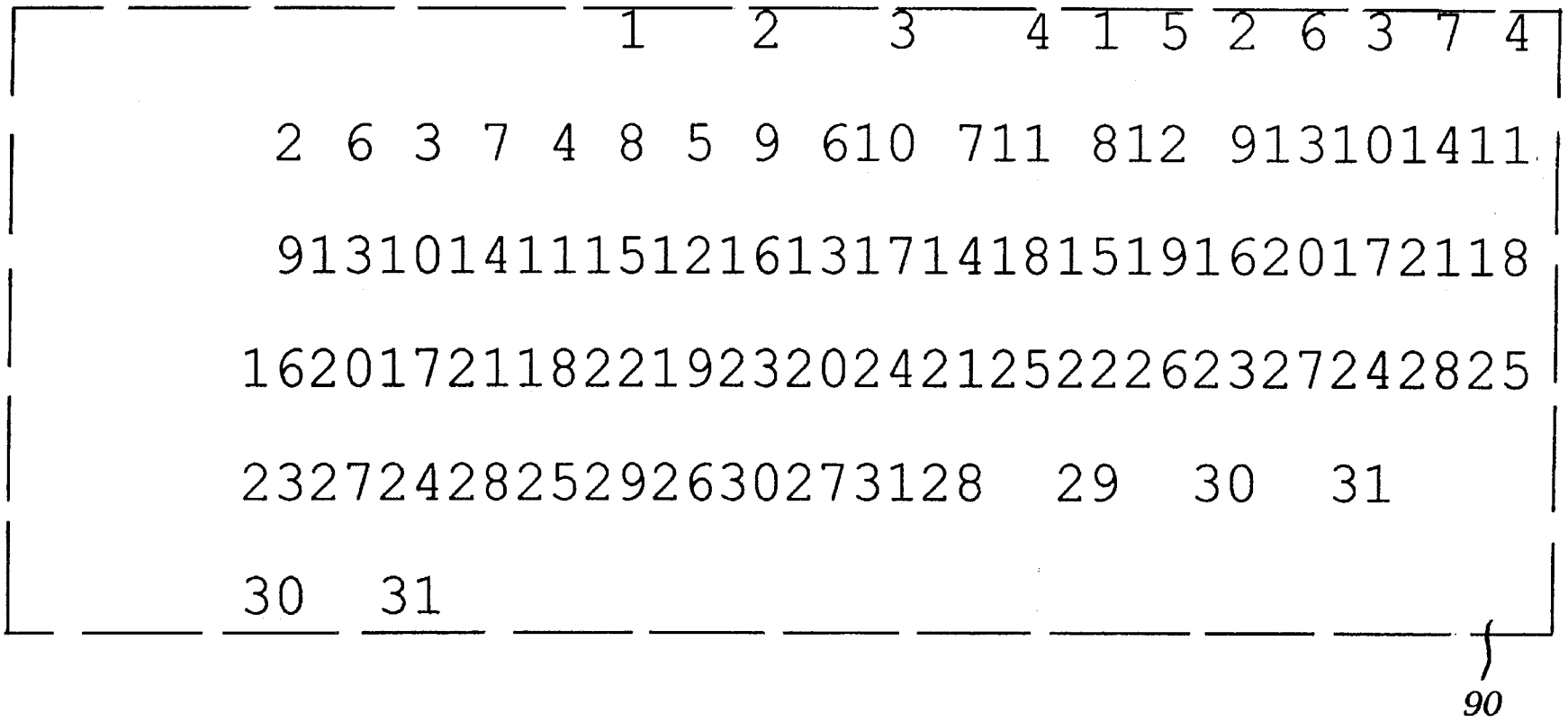
FIG. 9 illustrates a third embodiment of electrode patterns for a liquid crystal display of the present invention.

A third embodiment of electrode patterns for a liquid crystal display of the present invention is shown in FIG. 9. The only difference between this embodiment and the preferred embodiment is the absence of column 11 and the presence of column 90 in FIG. 9. Note that by making other changes to the preferred embodiment, other embodiments of the present invention are also possible.

Although the preferred embodiment has Sunday appearing in the leftmost displayed column, it should be readily apparent that in an alternative embodiment of this invention, any selected day can occupy the leftmost displayed column with the same efficiency in the use of electrodes and display panel face area as described above.

While there have been described what are considered to be the preferred and alternate embodiments of the invention, other modifications of the present invention will occur to those skilled in the art, and it is desired to secure in the appended claims all such modifications as fall within the true spirit and scope of the invention.

I claim:

1. An improved perpetual calendar display device of the type including first and second spaced and opposed patterns of electrodes having overlapped portions, and a liquid crystal material sandwiched between the electrode patterns, wherein the improvement comprises:

the overlapped portions of the opposed patterns of electrodes forming at least five rows and at least nineteen columns of numerals, the numerals commencing with numeral "1" consecutively increasing by one in alternating columns of each row such that at least three rows commencing with the second row have two sets of consecutive numerals interleaved among the columns; and circuit means for selecting and driving the electrodes for display or non-display, the circuit means being adapted to select at least four consecutive rows, and to select alternating columns for driving to display calendar months, the leftmost column of the displayed month being the same preselected day of the week regardless of which calendar month is displayed.

2. The calendar display device of claim 1, wherein the electrodes are driven by multiplexed voltage driving signals from the circuit means.

3. An improved perpetual calendar display device of the type including first and second spaced and opposed patterns of electrodes having overlapped portions, and a liquid crystal material sandwiched between the electrode patterns, wherein the improvement comprises:

the overlapped portions of the opposed patterns of electrodes forming six rows and nineteen columns of numerals, the numerals commencing with numeral "1" consecutively increasing by one in alternating columns of each row such that at least three rows commencing with the second row have two sets of consecutive numerals interleaved among the columns; and circuit means for selecting and driving the electrodes for display or non-display, the circuit means being adapted to select and display seven alternate columns of numerals comprising a calendar month, the leftmost column of the displayed month being the same preselected day of the week regardless of which calendar month is displayed.

4. The calendar display device of claim 3, wherein the leftmost numeral of the top row is a 1 and the rightmost numeral of the bottom row is a 31.

5. The calendar display device of claim 3, wherein the number of electrodes in the first pattern of electrodes is three, and the number of electrodes in the second pattern of electrodes is eight.

6. The calendar display device of claim 3, wherein the electrodes are driven by multiplexed voltage driving signals from the circuit means.

* * * * *